US011453137B2

(12) United States Patent
Godlieb et al.

(10) Patent No.: US 11,453,137 B2
(45) Date of Patent: Sep. 27, 2022

(54) SHAVING ASSEMBLY AND HAIR CUTTING APPLIANCE

(71) Applicant: KONINKLIJKE PHILIPS N.V., Eindhoven (NL)

(72) Inventors: Robert Godlieb, Drachten (NL); Johannes Tseard Van Der Kooi, Munein (NL); Martinus Bernardus Stapelbroek, Frieschepalen (NL); Albert Jan Aitink, Drachten (NL); Everhardus Johannes Hoexum, Groningen (NL); Ramachandra Rao Ganesh, Groningen (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 16/768,959

(22) PCT Filed: Nov. 26, 2018

(86) PCT No.: PCT/EP2018/082464
§ 371 (c)(1),
(2) Date: Jun. 2, 2020

(87) PCT Pub. No.: WO2019/110335
PCT Pub. Date: Jun. 13, 2019

(65) Prior Publication Data

US 2020/0331157 A1 Oct. 22, 2020

(30) Foreign Application Priority Data

Dec. 5, 2017 (CN) ..... 201721669741.4
May 11, 2018 (EP) ..... 18171809

(51) Int. Cl.
*B26B 19/38* (2006.01)
*B26B 19/06* (2006.01)

(52) U.S. Cl.
CPC ..... *B26B 19/384* (2013.01); *B26B 19/06* (2013.01); *B26B 19/3846* (2013.01)

(58) Field of Classification Search
CPC . B26B 19/3846; B26B 19/042; B26B 19/384; B26B 19/06
(Continued)

(56) References Cited

U.S. PATENT DOCUMENTS 1,846,622 A * 2/1932 Thompson ..... B26B 21/4006 30/346.56
2,102,529 A * 12/1937 Hanley ..... B26B 19/042 30/43.92
(Continued)

FOREIGN PATENT DOCUMENTS

| | | |
|---|---|---|
| CN | 106346519 | 1/2017 |
| EP | 2875917 | 5/2015 |
| WO | 2016/134979 | 9/2016 |

OTHER PUBLICATIONS

International Search Report and Written Opinion dated Feb. 15, 2019 for International Application No. PCT/EP2018/082464 Filed Nov. 26, 2018.
(Continued)

*Primary Examiner* — Laura M Lee

(57) ABSTRACT

To solve discomfort and safety issues caused by sharp glide sides, a shaving assembly and a hair cutting appliance including the shaving assembly with a protection element is provided. The shaving assembly comprising a supporting member; a cutting element extending in the first direction; a guard foil stretched and extending in the first direction and surrounding the cutting element, the guard foil including a bent part and a flat contact surface, wherein the bent part extends in the first direction for fixing the guard foil on the supporting member, and the flat contact surface is adapted to be in contact with skin; and a protection element arranged at
(Continued)

at least one end of the guard foil and including a curved surface exposed to the skin.

8 Claims, 4 Drawing Sheets

(58) Field of Classification Search
USPC ..... 30/43.92, 346.51, 34.1, 34.2
See application file for complete search history.

(56) References Cited

U.S. PATENT DOCUMENTS 2,152,815 A * 4/1939 Muros ..... B26B 19/06 30/43.92
2,194,465 A * 3/1940 Bott ..... B26B 19/06 30/43
2,222,107 A * 11/1940 Knapp ..... B26B 19/04 30/43.92
2,233,446 A * 3/1941 Andis ..... B26B 19/042 30/43.92
2,249,825 A * 7/1941 Hanley ..... B26B 19/042 30/43.92
2,253,037 A * 8/1941 Knapp ..... B26B 19/042 30/43.92
2,284,038 A * 5/1942 Bruecker ..... B26B 19/12 30/34.1
2,289,518 A * 7/1942 Raia ..... B26B 19/04 30/43.2
2,323,655 A * 7/1943 Hanley ..... B26B 19/38 30/43.92
2,519,332 A * 8/1950 Lonne ..... B26B 19/28 30/43.92
3,750,285 A * 8/1973 Michelson ..... B26B 21/4006 30/346.58
10,493,642 B2 * 12/2019 Bady ..... B26B 19/3813
10,596,715 B2 * 3/2020 Stapelbroek ..... B26B 19/3846
2008/0040935 A1 * 2/2008 Gratz ..... B26B 19/3813 30/539
2015/0314461 A1 * 11/2015 Man Wong ..... B26B 19/06 30/43.91

OTHER PUBLICATIONS

International Preliminary Report on Patentability dated March 3, 2020F or International Application No. PCT/EP2018/082464 Filed Nov. 26, 2018.
Written Opinion of the International Preliminary Examning Authority dated Nov. 11, 2019 for International Application No. PCT/EP2018/082464 Filed Nov. 26, 2018.

* cited by examiner

SHAVING ASSEMBLY AND HAIR CUTTING APPLIANCE

CROSS REFERENCE TO RELATED APPLICATIONS

This application is the U.S. National Phase application under 35 U.S.C. § 371 of International Application No. PCT/EP2018/082464 filed Nov. 26, 2018, published as WO2019/110335 on Jun. 13, 2019, which claims the benefit of European Patent Application Number 18171809.9 filed May 11, 2018 and Patent Application Number 201721669741.4 filed Dec. 5, 2017. These applications are hereby incorporated by reference herein.

FIELD OF THE INVENTION

Embodiments of present disclosure generally relate to home appliance, and more specifically, to a shaving assembly and a hair cutting appliance including the shaving assembly.

BACKGROUND OF THE INVENTION

Conventional trimmers or clippers for shaving and grooming facial hairs are designed to cut the hairs at a certain distance from the skin. Close shaving trimmers use a modified construction to enable hair cutting at a much closer distance from the skin than conventional trimmers. Normally, close shaving trimmers relies on thinner guard-teeth. Further, for achieving an effective and comfortable trim, complex rounding features and other features may also be needed.

In a construction, the first skin-contacting portion of the teeth may be constructed, for example, from a moldable material (such as, plastic) combined with the thin metal guard teeth to enable the close hair cutting.

In an alternative construction as disclosed in CN106346519A, a thin and flat metal sheet with guard teeth or hair-catching cut-outs is stretched over a molded base. This type of construction has an advantage in terms of cost, as it can be simply constructed from a flat sheet of thin foil. However, this construction does not address the comfort and safety issue at the sides gliding over the skin. The edges of both glide sides are straight and not optimal for shaving comfort or safety, as they are formed from a thin flat sheet by punching or cutting. In this case, uncomfortableness would be caused when the sharp glide slides are applied and glided on the skin.

SUMMARY OF THE INVENTION

In order to solve the discomfort and even safety issues caused by the sharp glide sides, embodiments of the present disclosure provide a shaving assembly with a protection element and a hair cutting appliance including the shaving assembly.

In a first aspect, a shaving assembly is provided. The shaving assembly comprises: a supporting member; a cutting element extending in the first direction; a guard foil stretched and extending in the first direction and surrounding the cutting element, the guard foil including a bent part and a flat contact surface, wherein the bent part extends in the first direction for fixing the guard foil on the supporting member, and the flat contact surface is adapted to be in contact with skin; and a protection element arranged at at least one end of the guard foil and including a curved surface exposed to the skin.

The protection element and the end of the guard foil are integrally formed. The protection element includes a rounded surface transiting from the contact surface of the guard foil to a bottom surface of the guard foil, wherein the rounded surface has a rounding radius larger than or equal to a thickness of the guard foil.

In this design, the rounded surface does not change the overall flat shape of the contact surface and only locally changes the profile of the edges in the thickness direction. Therefore, the overall stiffness of the guard foil can be well maintained. Moreover, no additional element (or part) as well as the simple fabrication make such protection element cost-effective.

According to embodiments of the present disclosure, the protection element can effectively avoid a direct contact of the user's skin with the non-proceeded sharp edges, thereby enabling a skin-friendly contact with the user's skin.

In a second aspect, a shaving assembly is provided. The shaving assembly comprises: a supporting member; a cutting element extending in the first direction; a guard foil stretched and extending in the first direction and surrounding the cutting element, the guard foil including a bent part and a flat contact surface, wherein the bent part extends in the first direction for fixing the guard foil on the supporting member, and the flat contact surface is adapted to be in contact with skin; and a protection element arranged at at least one end of the guard foil and including a curved surface exposed to the skin.

The protection element and the end of the guard foil are integrally formed. The protection element includes a curved portion transiting from the guard foil and constructed to be gradually curved in a direction away from the skin, wherein the curved portion includes a first curved surface transiting from the contact surface of the guard foil and a second curved surface transiting from a bottom surface of the guard foil.

According to embodiments of the present disclosure, the protection element can effectively avoid a direct contact of the user's skin with the non-proceeded sharp edges, thereby enabling a skin-friendly contact with the user's skin.

In this design, such curved portion with a receding edge is allowed to be curved or bent in a large space. Therefore, the curvature of the curved portion can be largely adjusted. Thereby enabling high design flexibility.

In a third aspect, a shaving assembly is provided. The shaving assembly comprises: a supporting member; a cutting element extending in the first direction; a guard foil stretched and extending in the first direction and surrounding the cutting element, the guard foil including a bent part and a flat contact surface, wherein the bent part extends in the first direction for fixing the guard foil on the supporting member, and the flat contact surface is adapted to be in contact with skin; and a protection element arranged at at least one end of the guard foil and including a curved surface exposed to the skin.

The protection element and the end of the guard foil are integrally formed. The protection element includes: a first curved portion transiting from the guard foil and constructed to be gradually curved in a direction towards the skin; and a second curved portion transiting from the first curved portion and constructed to be gradually curved in a direction away from the skin, wherein the first curved portion and the second curved portion jointly define the curved surface.

According to embodiments of the present disclosure, the protection element can effectively avoid a direct contact of the user's skin with the non-proceeded sharp edges, thereby enabling a skin-friendly contact with the user's skin.

In this design, no additional element or part is required, which makes the protection element cost-effective. Moreover, the slight raising of the receding edge creates a small 'bulge', which can help in balancing the bending stress from the side for the main functional bend for the guard teeth. Meanwhile, such a small bulge has little to no effect on shaving performance.

In a fourth aspect, a shaving assembly is provided. The shaving assembly comprises: a supporting member; a cutting element extending in the first direction; a guard foil stretched and extending in the first direction and surrounding the cutting element, the guard foil including a bent part and a flat contact surface, wherein the bent part extends in the first direction for fixing the guard foil on the supporting member, and the flat contact surface is adapted to be in contact with skin; and a protection element arranged at at least one end of the guard foil and including a curved surface exposed to the skin.

The protection element is constructed as a bead made of lacquer or resin and having a rounded profile surrounding the end of the guard foil.

Such protection element formed by for example a simple dipping or edge-painting of the sharp edge can provide an effective and low-cost protection solution. Moreover, a sufficient durability for the shaving lifetime of the shaving assembly can be achieved.

According to embodiments of the present disclosure, the protection element can effectively avoid a direct contact of the user's skin with the non-proceeded sharp edges, thereby enabling a skin-friendly contact with the user's skin.

In a fifth aspect, a hair cutting appliance is provided. The hair cutting appliance comprises: a shaving assembly according to the first aspect of the present disclosure; and a driving mechanism configured to cause a movement of the cutting element inside the shaving assembly.

Through the following discussions, it would be apparent that compared to conventional hair cutting appliance, the hair cutting appliance including the skin-friendly shaving assembly according to various embodiments of present disclosure avoids a direct contact of the sharp edge to the user's skin, and thereby the discomfort and safety issue can be eliminated. Meanwhile, due to the less-expensive components and less-complex rounding design, the overall cost of the appliance is reduced and the fabrication/assembly is simplified.

BRIEF DESCRIPTION OF THE DRAWINGS

Drawings described herein are provided to further explain the present disclosure and constitute a part of the present disclosure. The example embodiments of the disclosure and the explanation thereof are used to explain the present disclosure, rather than to limit the present disclosure improperly.

Throughout the drawings, the same or similar reference symbols are used to indicate the same or similar elements.

DETAILED DESCRIPTION OF THE EMBODIMENTS

Figure 1A:
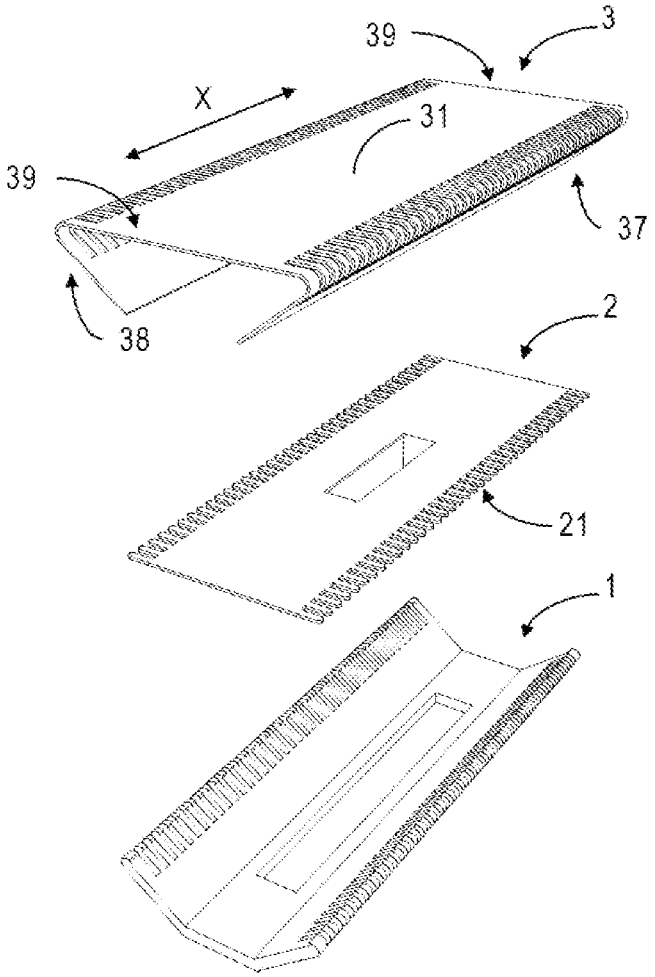
Fig. 1A (Prior Art)
FIG. 1A illustrates a perspective view of a conventional shaving assembly in an unassembled status.

Principles of the present disclosure will now be described with reference to several example embodiments shown in the drawings. Though example embodiments of the present disclosure are illustrated in the drawings, it is to be understood that the embodiments are described only to facilitate those skilled in the art in better understanding and thereby achieving the present disclosure, rather than to limit the scope of the disclosure in any manner.

FIG. 1A illustrates a perspective view of a conventional shaving assembly 100 in an unassembled status. As shown, the shaving assembly 100 generally includes a supporting member 1, a cutting element 2 extending in a first direction X, and a guard foil 3 also extending in the first direction X.

The contact surface 31 includes a plurality of guard teeth 37 (also referred to as "hair-catching cut-outs") arranged along the first direction X, and the cutting element 2 includes a plurality of moving teeth 21 arranged along the first direction X. In operation, under the control of a driving mechanism (is not shown), the moving teeth 21 are adapted to move (or oscillate) with respect to the plurality of guard teeth 37 along the first direction X. For sake of discussion, the first direction X may be considered as a longitudinal direction of the shaving assembly 100.

Figure 1B:
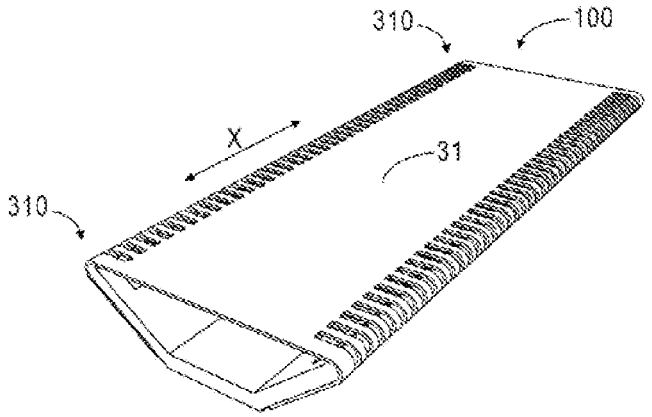
Fig. 1B (Prior Art)
FIG. 1B illustrates a perspective view of the shaving assembly of FIG. 1A in an assembled status.

FIG. 1B illustrates a perspective view of the shaving assembly 100 in an assembled status. As shown, the guard foil 3 is stretched and surrounding the cutting element 2 via a bend of a part of the guard foil 3 with respect to an axis along the first direction X. In some embodiments, the thickness of the guard foil 3 is in a range of 40 to 120 micrometers, for example, 80 micrometers.

The guard foil 3 includes a bent part 38 and a flat contact surface 31. The bent part 38 extends in the first direction X for fixing the guard foil 3 on the supporting member 1. The flat contact surface 31 is adapted to be in contact with skin of a user.

In addition to the two lateral sides along the first direction X, as further illustrated in FIG. 1B, the flat contact surface 31 also includes two glide edges 39 which are oriented substantially perpendicular to the first direction X and exposed to the user's skin with no protection means provided thereon. As discussed above, in view of the fact that the glide edges 39 are formed by punching or cutting from a thin metal foil, these two glide edges 39 are usually sharp and not optimal for shaving comfort or safety.

In view of the forgoing, according to various embodiments of the present disclosure, the shaving assembly 100 as shown in FIGS. 1A-1B is further equipped with a skin-friendly protection element 4. The protection element 4 is arranged at the ends 310 of the guard foil 3 and includes a curved surface 41 exposed to the skin of the user. In this way, a direct contact of sharp edges with the skin of the user can be avoided, thereby improving the shaving comfort and guaranteeing the shaving safety.

Various embodiments of the shaving assembly 100 with the protection element 4 are described below with reference to FIGS. 2A-6C.

Figure 2A:
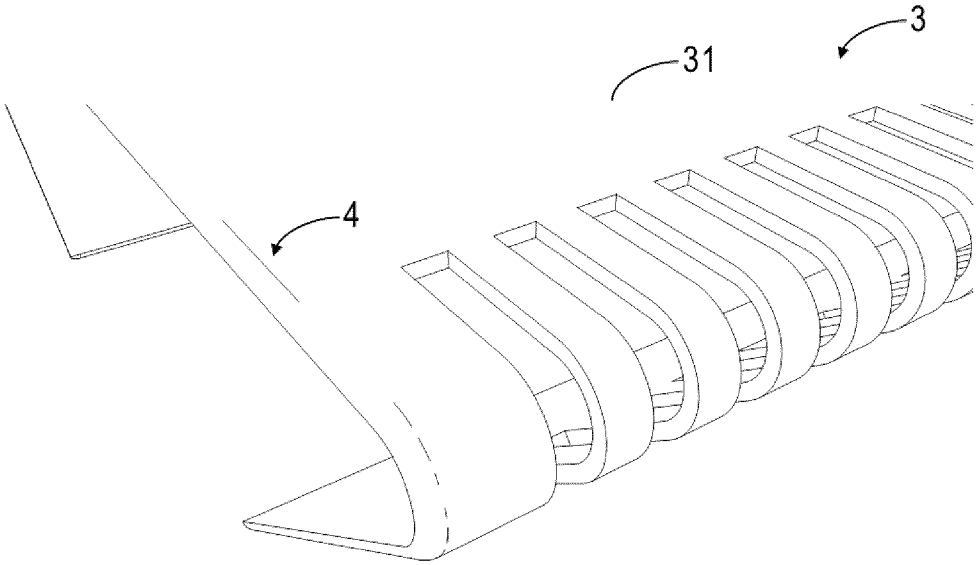
FIG. 2A illustrates a perspective view of a shaving assembly including a protection component constructed as a part of a guard foil, in accordance with embodiments of the present disclosure.
Figure 2B:
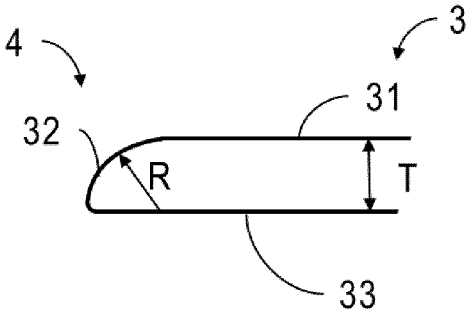
FIG. 2B illustrates a cross-sectional view of a shaving assembly including a protection component of FIG. 2A.

In some embodiments, the protection element 4 and the ends 310 of the guard foil 3 can be integrally formed. In other words, the protection element 4 may be considered as a part of the guard foil. In an example embodiment, as shown in FIGS. 2A-2B, the protection element 4 may include a rounded surface 32 that is transiting from the contact surface 31 of the guard foil 3 to a bottom surface 33 of the guard foil 3. FIG. 2B shows a cross-sectional view of the protection element 4 along the first direction X. As shown, the rounded surface 32 may have a rounding radius R that is larger than or equal to a thickness T of the guard foil 3.

Such an arced edge with a radius approaching the thickness of the guard foil 3 (may also referred to as "a radiused edge") can be achieved, for example, by polishing the edges of the contact surface 31. The radiused edge does not change the overall flat shape of the contact surface 31 and only locally changes the profile of the edge in the thickness direction, or in other words, the bottom surface 33 of the guard foil 3 is kept substantially flat. Therefore, the overall stiffness of the guard foil 3 can be well maintained. Moreover, no additional element or part, as well as the simple polishing proceeding, make the protection element cost-effective.

Figure 3:
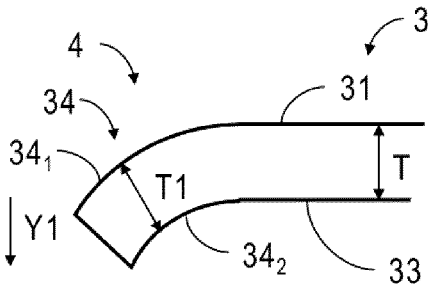
FIG. 3 illustrates a cross-sectional view of a shaving assembly including a protection component constructed as a part of a guard foil, in accordance with embodiments of the present disclosure.

Alternatively, in another example embodiment as shown in FIG. 3, the protection element 4 includes a curved portion 34 transiting from the guard foil 3 and constructed to be gradually curved in a direction away from the skin Y1. In this design, the curved portion 34 includes a first curved surface $\mathbf{34}_1$ transiting from the contact surface 31 of the guard foil 3 and a second curved surface $\mathbf{34}_2$ transiting from a bottom surface 33 of the guard foil 3.

In some embodiments, the curved portion 34 may have a uniform thickness T1 that is substantially equal to the thickness T of the guard foil 3. In some other embodiments, variation in thickness throughout the curved portion 34 may be allowed.

Because such curved portion 34 with a receding edge is allowed to be curved or bent in a large space, the curvature of the curved portion 34 can be largely adjusted. Thereby enabling high design flexibility.

Figure 4A:
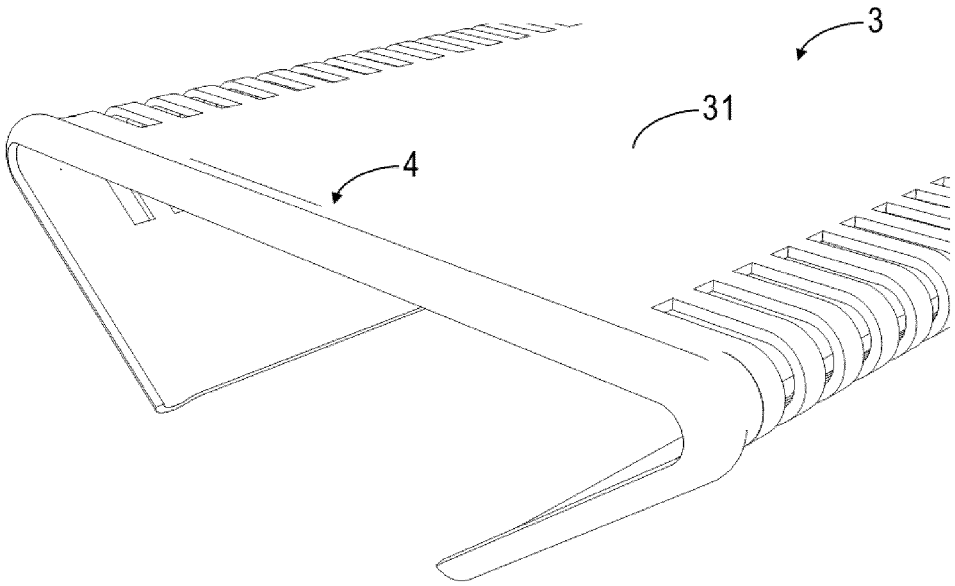
FIG. 4A illustrates a perspective view of a shaving assembly including a protection component constructed as a part of a guard foil, in accordance with embodiments of the present disclosure.
Figure 4B:
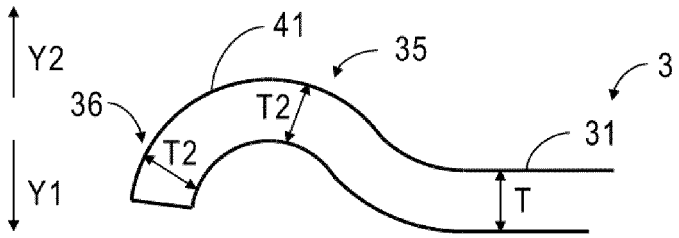
FIG. 4B illustrates a cross-sectional view of a shaving assembly including a protection component of FIG. 4A.

In yet another example embodiment, the protection element 4 may include a first curved portion 35 and a second curved portion 36, and which jointly define the curved surface 41. For example, as shown in FIGS. 4A-4B, the first curved portion 35 is transiting from the guard foil 3 and constructed to be gradually curved in a direction towards the skin Y2, and the second curved portion 36 is transiting from the first curved portion 35 and constructed to be gradually curved in a direction away from the skin Y1.

In some embodiments, the first curved portion 35 and the second curved portion 36 may have a uniform thickness T2 that is substantially equal to a thickness T of the guard foil 3. In some other embodiments, variation in thickness throughout the first curved portion 35 and second curved portion 36 may be allowed In this design, no additional element or part is required, which makes the protection element cost-effective. Moreover, compared to the receding edge as shown in FIG. 3, the slight raising of the receding edge creates a small 'bulge', which can help in balancing the bending stress from the side for the main functional bend for the guard teeth 37. Meanwhile, such a small bulge has little to no effect on shaving performance.

Figure 5A:
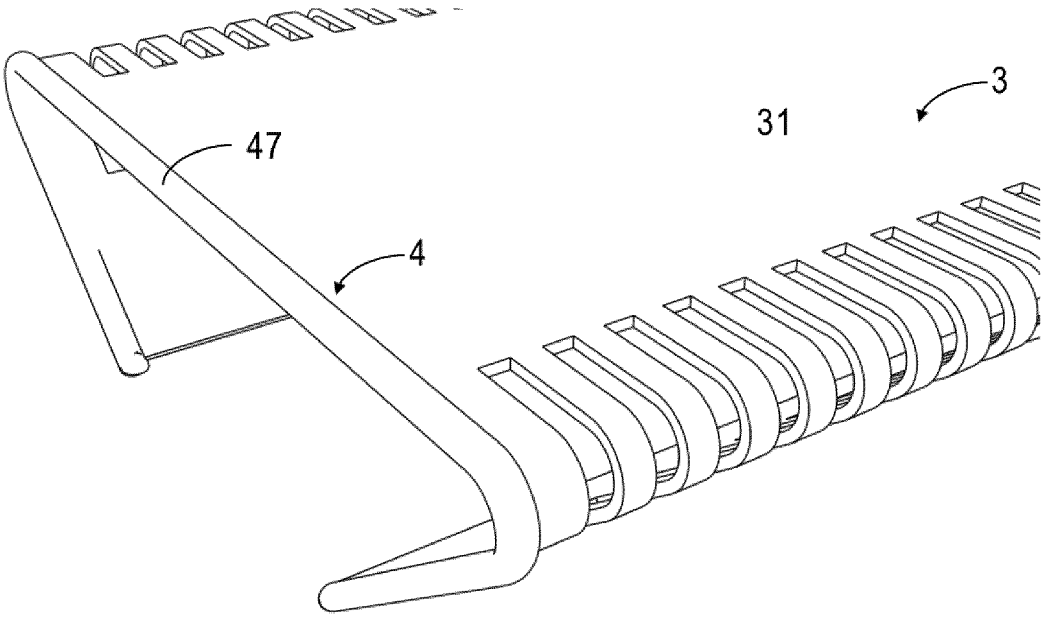
FIG. 5A illustrates a perspective view of a shaving assembly including a protection component constructed as a separate component, in accordance with embodiments of the present disclosure.
Figure 5B:
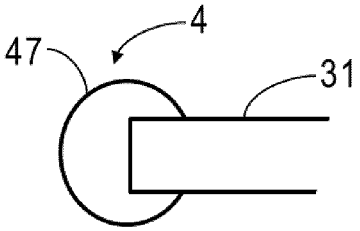
FIG. 5B illustrates a cross-sectional view of a shaving assembly including a protection component of FIG. 5A.

In some embodiment as shown FIGS. 5A-5B, the protection element 4 can be constructed as a bead made of lacquer or resin and having a rounded profile 47 surrounding the end 310 of the guard foil 3. Such protection element 4 formed by for example a simple dipping or edge-painting of the sharp edge can provide an effective and low-cost protection solution. Moreover, a sufficient durability for the shaving lifetime of the shaving assembly 100 can be achieved due to the additional protection bead.

It is to be understood that the above detailed embodiments of the present disclosure are only to exemplify or explain principles of the present disclosure and not to limit the present disclosure. The appended claims of the present disclosure aim to cover all the variations and modifications falling under the scope and boundary of the claims or equivalents of the scope and boundary.

The invention claimed is:

1. A shaving assembly, comprising:

a supporting member;

a cutting element configured as a continuous planar plate having an upper surface and a bottom surface extending in a first direction, the cutting element further having a plurality of moving teeth arranged at lateral sides of the cutting element at respective cutting edges along the first direction;

a guard foil including a bent part and a planar contact surface, stretched and extending in the first direction and surrounding the cutting element, wherein the top surface of the cutting element is in proximal contact with the underside of the planar contact surface of the guard foil, wherein the bent part extends in the first direction for fixing the guard foil on the supporting member, and a flat contact surface is adapted to be in contact with skin;

a protection element arranged at at least one end of the guard foil and including a curved surface exposed to the skin;

wherein the protection element and the end of the guard foil are integrally formed; and wherein the protection element is constructed as a bead made of lacquer or resin and having a rounded profile surrounding the end of the guard foil so as to be integrally formed with the guard foil, whereby the rounded profile transitions in the first direction extending from the contact surface of the guard foil to a bottom surface of the guard foil and transitions continuously along the entire width of the guard foil, transverse to said first direction.

2. A hair cutting appliance, comprising:

a shaving assembly according to claim 1; and a driving mechanism configured to cause a movement of the cutting element inside the shaving assembly.

3. A shaving assembly, comprising:

a supporting member;

a cutting element configured as a continuous planar plate having an upper surface and a bottom surface extending in a first direction, the cutting element further having a plurality of moving teeth arranged at lateral sides of the cutting element at respective cutting edges along the first direction;

a guard foil including a bent part and a planar contact surface, stretched and extending in the first direction and surrounding the cutting element, wherein the top surface of the cutting element is in proximal contact with the underside of the planar contact surface of the guard foil, wherein the bent part extends in the first direction for fixing the guard foil on the supporting member, and a flat contact surface is adapted to be in contact with skin;

a protection element arranged at at least one end of the guard foil and including a curved surface exposed to the skin;

wherein the protection element and the end of the guard foil are integrally formed; and wherein that the protection element includes a curved portion transitioning from the guard foil and constructed to be gradually curved in a direction away from the skin, wherein the curved portion includes a first curved surface transitioning from the contact surface of the guard foil and a second curved surface transitioning from a bottom surface of the guard foil, and wherein the protection element is constructed as a bead made of lacquer or resin and having a rounded profile, including the first and second curved surfaces, surrounding the end of the guide foil so as to be integrally formed with the guard foil, whereby the rounded profile transitions in the first direction extending from the contact surface of the guard foil to a bottom surface of the guard foil and transitions continuously along the entire width of the guard foil, transverse to said first direction.

4. A shaving assembly, comprising:

a supporting member;

a cutting element configured as a continuous planar plate having an upper surface and a bottom surface extending in a first direction, the cutting element further having a plurality of moving teeth arranged at lateral sides of the cutting element at respective cutting edges along the first direction;

a guard foil including a bent part and a planar contact surface, stretched and extending in the first direction and surrounding the cutting element, wherein the top surface of the cutting element is in proximal contact with the underside of the planar contact surface of the guard foil, wherein the bent part extends in the first direction for fixing the guard foil on the supporting member, and a flat contact surface is adapted to be in contact with skin;

a protection element arranged at at least one end of the guard foil and including a curved surface exposed to the skin;

wherein the protection element and the end of the guard foil are integrally formed; and wherein the protection element includes:

a first curved portion transitioning from the guard foil and constructed to be gradually curved in a direction towards the skin;

a second curved portion transitioning from the first curved portion and constructed to be gradually curved in a direction away from the skin; and wherein the first curved portion and the second curved portion jointly define the curved surface, and wherein the protection element is constructed as a bead made of lacquer or resin and having a rounded profile, including the first and second curved surfaces, surrounding the end of the guide foil so as to be integrally formed with the guard foil, whereby the rounded profile transitions in the first direction extending from the contact surface of the guard foil to a bottom surface of the guard foil and transitions continuously along the entire width of the guard foil, transverse to said first direction.

5. The shaving assembly of claim 4, wherein the thickness of the first and second curved portions are not equal to a thickness of the guard foil.

6. The shaving assembly of claim 4, wherein the flat contact surface of the guard foil includes first and second edges oriented substantially perpendicular to the first direction.

7. The shaving assembly of claim 6, wherein the first and second edges are entirely encapsulated by the protection element thereby avoiding direct contact of the first and second glide edges with the skin.

8. A shaving assembly, comprising:

a supporting member;

a cutting element configured as a continuous planar plate having an upper surface and a bottom surface extending in a first direction, the cutting element further having a plurality of moving teeth arranged at lateral sides of the cutting element at respective cutting edges along the first direction;

a guard foil including a bent part and a planar contact surface, stretched and extending in the first direction and surrounding the cutting element, wherein the top surface of the cutting element is in proximal contact with the underside of the planar contact surface of the guard foil, wherein the bent part extends in the first direction for fixing the guard foil on the supporting member, and a flat contact surface is adapted to be in contact with skin;

a protection element arranged at at least one end of the guard foil and including a curved surface exposed to the skin;

wherein the protection element is constructed as a bead made of lacquer or resin and having a rounded profile surrounding the end of the guard foil so as to be integrally formed with the guard foil, whereby the rounded profile transitions in the first direction extending from the contact surface of the guard foil to a bottom surface of the guard foil and transitions continuously along the entire width of the guard foil, transverse to said first direction, and wherein the protection element is formed by a simple dipping or edge-painting of the end.

* * * * *